United States Patent [19]

Swiatosz et al.

[11] 4,050,166

[45] Sept. 27, 1977

[54] RECOIL SIMULATOR

[75] Inventors: Edmund Swiatosz; Albert H. Marshall, both of Maitland, Fla.

[73] Assignee: The United States of America as represented by the Secretary of the Navy, Washington, D.C.

[21] Appl. No.: 723,488

[22] Filed: Sept. 30, 1976

[51] Int. Cl.[2] ..... G09B 9/00; F41F 27/00

[52] U.S. Cl. ..... 35/25; 273/101.1; 273/101.2

[58] Field of Search ..... 35/25, 13, 19 R; 273/101.1, 101.2; 240/6.41; 340/323 R (U.S. only)

[56] References Cited

U.S. PATENT DOCUMENTS

| | | | |
|---|---|---|---|
| 1,954,509 | 4/1934 | Yates | 273/101.2 |
| 2,520,281 | 8/1950 | Heide | 35/25 |
| 2,618,719 | 11/1952 | Durant et al. | 340/323 X |
| 2,845,270 | 7/1958 | Durant | 273/101.2 |
| 2,928,190 | 3/1960 | Evans | 273/101.1 X |
| 3,141,246 | 7/1964 | Boris | 35/25 |
| 3,220,732 | 11/1965 | Pincus | 273/101.1 |
| 3,633,285 | 1/1972 | Sensney | 35/25 |
| 3,704,530 | 12/1972 | Arenson | 35/25 |

*Primary Examiner*—William H. Grieb
*Assistant Examiner*—Vance Y. Hum
*Attorney, Agent, or Firm*—Richard S. Sciascia; Don D. Doty

[57] ABSTRACT

A recoil simulator is disclosed which generates various predetermined motions and forces that may be imparted to training guns, weapons, and other devices, so as to give them realistic operational characteristics which they otherwise would not have. To generate such motions and forces — and, thus, to effect such operational characteristics — a given mass is moved along a predetermined axis thereof while the displacements, velocities, and accelerations thereof are controlled by an unusual combination of mass positioning and cocking device, compression springs, and electric solenoids, the latter of which is timely energized by a unique electronic programmer circuit.

19 Claims, 6 Drawing Figures

RECOIL SIMULATOR

FIELD OF THE INVENTION

The present invention relates, in general, to simulation of the effects of the motions of various and sundry apparatus and, in particular, is a recoil simulator. In even greater particularity, the subject invention comprises a weapon recoil simulator which may be incorporated to an advantage in laser or other guns not using live ammunition, so as to make them have recoil characteristics which are similar to those produced by guns firing conventional shells. So doing, of course, enables marksmen to be trained by using laser guns instead of real guns as practice weapons and still have a feeling with respect thereto that is similar to the feeling they would have if they were firing various and sundry real guns (or other weapons); hence, it could reasonably be said that the instant invention comprises a training gun recoil simulator, too.

DESCRIPTION OF THE PRIOR ART

Numerous gun recoil simulators have heretofore been used in training and shooting gallery guns to simulate the "kicking" of a real gun against the shoulder of the person firing it, say, for markman training or other purposes. Two of such gun recoil simulators are disclosed in the prior art.

In the aforementioned prior art, for example, in response to trigger action, compressed air from a supply tube is applied to one end of a piston, the other end of which compresses a spring rearwardly against the stock (or frame) of a shooting gallery type gun to provide a back kick effect, thereby simulating the kicking of a real gun when fired.

In another teaching of prior art, in response to trigger action, a solenoid is energized in such manner as to cause a movable magnetic structure to effectively impart an impact upon the butt of an imitation gun, thereby simulating a recoil force against the shoulder of the person using it.

Although satisfactory for some purposes — such as, for providing recoil simulations that are adequate for simple shooting gallery type guns — the aforementioned prior art recoil mechanisms leave something to be desired when it comes to providing training for the firing of real weapons using live ammunition, inasmuch as they do not, in fact, simulate the recoil of any of such weapons presently in existence.

SUMMARY OF THE INVENTION

It is a well known fact that the recoil experience of marksman using actual live ammunition firing guns has a significant effect on his marksmanship. And, furthermore, if said marksman were s trainee marksman, his training would be adversely affected by using artificial guns not having real gun recoil characteristics. In other words, unless the training gun he is firing feels approximately the same as the real gun he is being trained to shoot, his training is deficient and, in all probability, ineffective. Therefore, in such case, it would be unrealistic to expect a positive transfer of experience from training weapons that do not use live ammunition to ones that do, if the recoil mechanism incorporated therein does not actually simulate the recoil experience obtained from using real guns. Hence, as will become evident from the disclosure presented below, the instant invention overcomes many of the disadvantages of the known prior art gun recoil mechanism.

The recoil mechanism constituting the present invention is relatively simple but high effective because it more nearly simulates real weapon recoil characteristics and, moreover, may be designed and adjusted to the extent that it will simulate the recoil characteristics of many different guns, weapons, and other devices, including the M-16 rifle.

Briefly, the invention includes a pair of pull (or push) type solenoids mounted in tandum with a slidable or movable mass therebetween which is forced to move in certain ways — and, thus, with certain momentums — back and forth along the axis of revolution thereof and with and against predetermined spring actions in accordance with a unique timing program. Of course, as will be explained more fully below, said mass is also timely cocked and latched in place in such manner by another solenoid and latch mechanism that it will be released upon the pulling of the trigger of any mock gun in which it is installed. The aforesaid timing program is implemented by means of a programmer operating in unusual combination with the aforementioned solenoids and trigger, thereby effecting a cycle of events within the subject invention which causes a recoil characteristic to occur with respect to such mock gun as to make it feel like a real one when fired by a marksman trainee.

Therefore, an object of this invention is to provide an improved recoil simulator.

Another object of this invention is to provide means for making an imitation gun which does not fire live ammunition feel like a real gun that does to a practicing marksman or trainee.

A further object of this invention is to enable a laser rifle incorporating it to be used as a training rifle which realistically simulates the action forces of a predetermined live ammunition firing gun, thereby facilitating the economical and safe training or riflemen.

Still another object of this invention is to provide an improved means for controlling the movements of various and sundry mechanisms, as a result of varying the momentums thereof in a programmed manner.

Another object of this invention is to provide a uniquely programmed recoil simulator for weapons and other devices.

Another object of this invention is to provide a weapon recoil simulator system which is relatively easy and economical to manufacture, use, and maintain.

Other objects and many of the attendant advantages of this invention will be readily appreciated as the same becomes better understood by reference to the following detailed description when considered in connection with the accompanying drawings wherein:

DESCRIPTION OF THE PREFERRED EMBODIMENT

Figure 1:
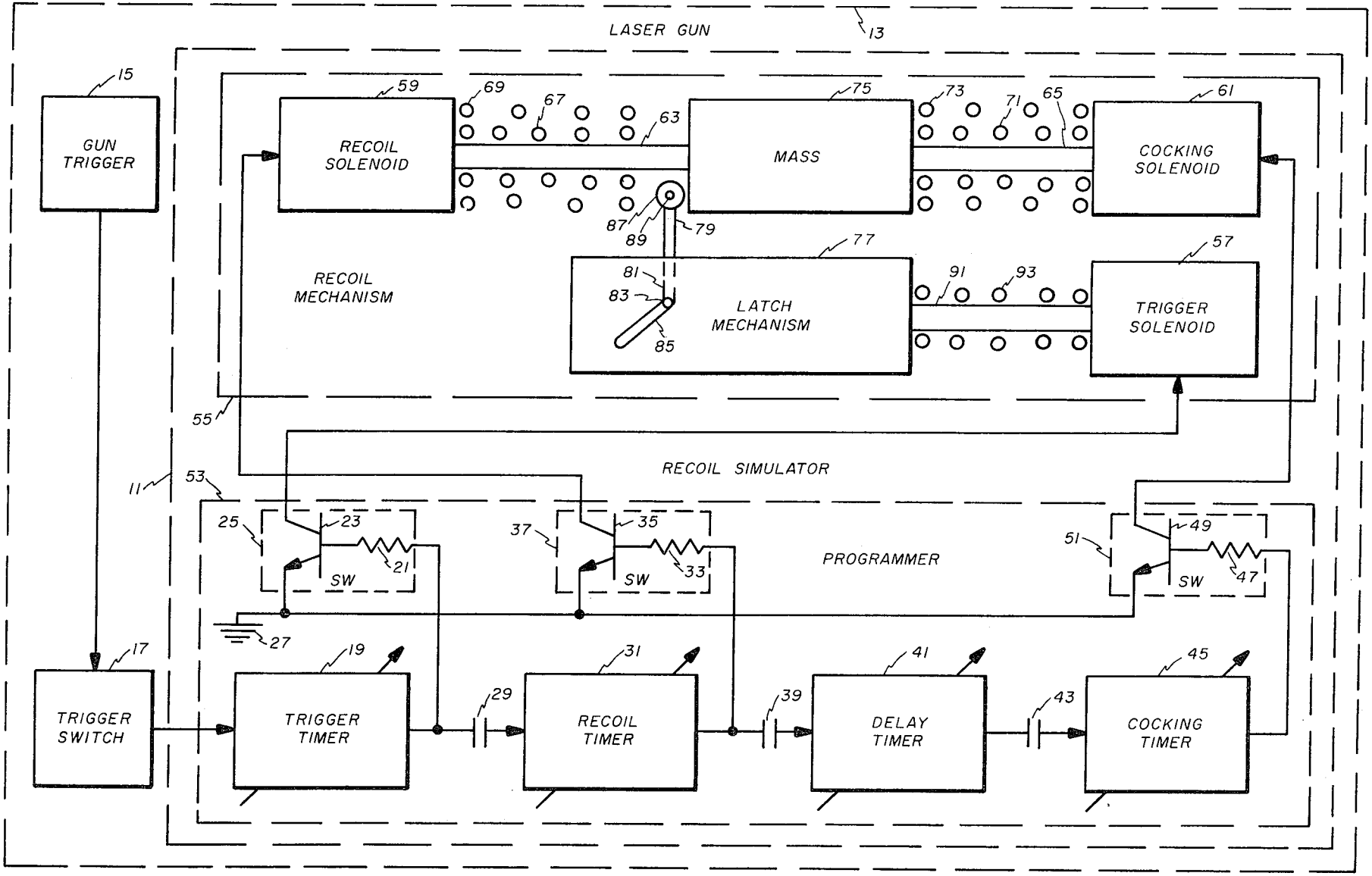
FIG. 1 is a combination block and schematic diagram representing the recoil simulator constituting this invention.

Referring now to FIG. 1, there is disclosed a recoil simulator 11 of the type constituting this invention which is incorporated in a laser gun 13 for the purpose of giving it predetermined recoil force and movement characteristics.

At the outset, however, although recoil simulator 11 is depicted herein as being a laser gun recoil simulator, it should be understood that it may be incorporated in any other gun, imitation gun, weapon, or the like, or in any other device or in combination with any other mechanism, the effective recoil-like motion of which is desired to be controlled, as described subsequently, without violating the scope or spirit of the invention. Obviously, it would be well within the purview of the artisan having the benefit of the teachings presented herewith to make whatever design selections as would be necessary to combine the subject invention with any device compatible therewith for any operational purpose. Accordingly, the discussion thereof will not be belabored at this time, so as to keep the disclosure of the instant invention as simple as possible.

As is conventional with practically all guns, laser gun 13 contains a gun trigger 15 which is pulled by the marksman firing it, and connected thereto is a normally open trigger switch 17 which is effectively closed by the pulling of said trigger 15.

The output of trigger switch 17 is connected to the input of a suitable, adjustable trigger timer 19, such as, for example, model number 555 manufactured by the Signetics Corporation of Sunnyvale, Calif., the output of which is connected through a resistance 21 to the base of a NPN transistor 23, the combination of which, in effect, constitutes an electronic switch 25. The emitter of transistor 23 is connected to a ground 27.

The output of trigger timer 19 is also connected through a circuit isolation, coupling capacitor 29 to the input of an adjustable recoil timer 31, the output of which is, in turn, connected through a resistance 33 to the base of another NPN transistor 35, the combination of which, in effect, constitutes an electronic switch 37. The emitter of transistor 35 is connected to the aforesaid ground 27.

The output of recoil timer 31 is, in addition, connected through a circuit isolation, coupling capacitor 39 to the input of an adjustable delay timer 41, the output of which is connected through a circuit isolation, coupling capacitor 43 to the input of an adjustable cocking timer 45. The output of cocking timer 45 is connected through a resistance 47 to the base of an NPN transistor 49, the combination of which constitutes an electronic switch 51.

From the foregoing and the inspection of FIG. 1, it may readily be seen that the aforesaid elements referred to by reference numerals 17 through 51 constitute a programmer 53 that is intended to time the respective operations of the various and sundry elements of a recoil mechanism 55.

Programmer 53 has a trio of outputs which are taken from the collectors of the aforementioned transistors 23, 35 and 49, respectively, and they are connected to the inputs of a trio of solenoids 57, 59, 61, respectively, incorporated in the aforementioned recoil mechanism 55. Of course, in this particular instance, solenoid 57 is a trigger solenoid, solenoid 59 is a recoil solenoid, and solenoid 61 is a cocking solenoid.

Recoil solenoid 59 includes a connecting rod or armature shaft 63 which is moved or drawn therein by electromagnetic action when it is energized. Likewise, cocking solenoid 61 includes a connecting rod or armature shaft 65 which is moved or drawn therein by electromagnetic action when it is energized. Extending along and surrounding shaft 63 is a compressible resilient means such as a pair of concentrically wound springs 67 and 69, the design of which will be discussed more fully later on. However, suffice to say at this time, they are to be designed to give the spring action necessary to contribute to effecting the type of recoil to be simulated. Also, another pair of concentrically disposed spring 71 and 73 are mounted along and around shaft 65 in such manner as to provide whatever compression thereof is necessary for any given operational circumstances. Of course, springs 71 and 73 may be replaced by any other resilient means having a spring rate comparable thereto.

Between those extremities of shafts 63 and 65 that are opposite solenoids 59 and 61, a predetermined mass 75 is connected for movement therewith. As illustrated in FIG. 1, said shaft 62 is somewhat longer than springs 67 and 69; hence, there is considerable play between the left end of mass 75 and the right ends of springs 67 and 69 when mass 75 is in cocked position, as depicted in FIG. 1. But, there is no play between the right end of mass 75 and the left ends of springs 71 and 73 when mass 75 is in a cocked position, as shown.

The cocking of mass 75 is effected by latch mechanism 77 containing a small shaft 79 moved up and down in its bearing 81 in latch mechanism 77 as a result of cam follower pin 83 at the end thereof being actuated by cam-slot 85, as said latch mechanism is moved left and right in a direction, say, substantially normal to shaft 79. To facilitate the latching and unlatching of mass 75 for "cocking" and "firing" purposes, an appropriate roller 87 is rotatably mounted on the end of shaft 79 by a bearing shaft 89 and in such manner that it will timely and rotatably engage with the end of mass 75 and, thus, hold it in place — that is, in a cocked position — against the urging of compressed springs 71 and 73.

The aforesaid trigger solenoid 57 also comprises a shaft 91 which is drawn therein when energized, and said shaft 91 is attached as a connecting rod to latch mechanism 77, so as to effect the left and right movement thereof for latch and unlatch purposes. Another resilient means, such as compression spring 93, is mounted along and around shaft 91 in such manner that it is compressed when mass 75 is in a latched or cocked position.

At this time, it would perphaps be noteworthy that all of the elements and components used in the invention are well known, conventional, and commercially available; therefore, it should be understood that it is their unique interconnections and interactions that effect a new combination of elements which constitutes the present invention and causes it to produce the results and accomplish the objectives mentioned above.

Moreover, it should be obvious that whatever electrical power is required to make the subject recoil simulator work, is available, either external to or within gun 13.

THEORY OF OPERATION

Although the mode of operation of the instant invention is relatively simple, the theory of design and operation thereof is rather complex, inasmuch as the interaction of the various components of recoil mechanism 55 must be such that precise relative actuations and/or movements thereof occur in accordance with the particular timing program of programmer 53, if they are to function in such manner as to effect a worthwhile simulation of the recoil of a real gun or other weapon.

Because the subject recoil mechanism essentially consists of a spring-mass vibration system, the theoretical recoil motion analysis may be obtained by determining the response of the mass thereof to the spring and solenoid forces. And since said forces are somewhat discontinuous in this particular case, the equations of motion will be different for each thereof. Moreover, the final velocities of each operation must be employed as the initial conditions for the next operation in the sequence of operations that occur in the subject device. Therefore, it is necessary, in order to effect the recoil force simulations of a particular gun (or other apparatus), to calculate the time intervals and velocities for each sequential operation of the active and reactive components incorporated in the instant invention. And, thus, by selecting suitable parameters and characteristics for the mass, spring, and solenoid forces, the response of the instant recoil mechanism may be designed to meet most any weapon recoil simulation requirements.

Figure 2:
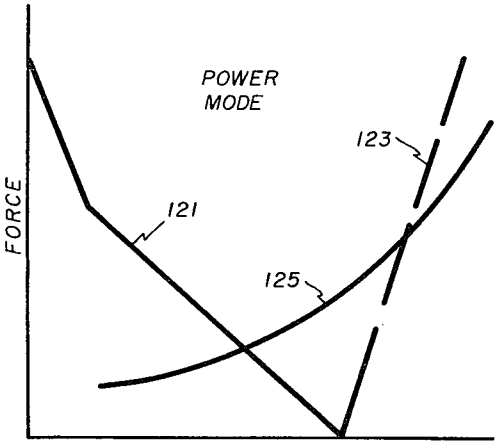
FIG. 2 is a representative graphical illustration of forcemass displacement actions designed into the spring and solenoid components of the invention that are operators for the power mode of operation thereof.

Referring now to FIG. 2, there is shown a plurality of curves which represent a typical selection of spring and solenoid forces for various forward mass displacements during the power mode of the instant invention. For instance, varying slope curve 121 may be the result of a proper selection and combination of springs 71 and 73 having certain different spring rates, respectively; constant slope curve 123 may be the result of a useful selection and combination of springs 67 and 69 having certain similar spring rates (although they could be different, too); and curve 125 may be the result of a suitable selection for recoil solenoid 59 and the forces produced thereby as a result of the timely electrical energization thereof. Again, the forceforward mass displacement curves of FIG. 2 should be considered as being representative only, since the design choice of the components thereof would have to be contingent upon what gun recoil was being simulated.

Figure 3:
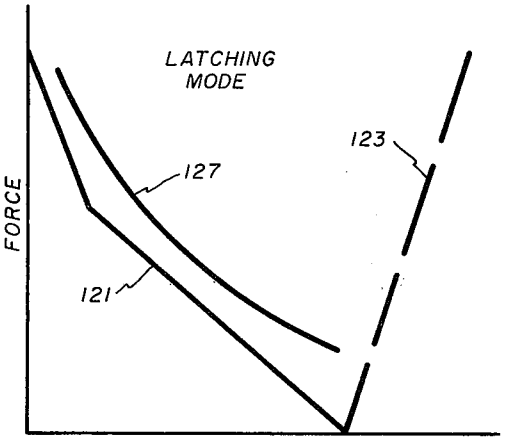
FIG. 3 is a representative graphical illustration of forcemass displacement actions designed into those spring and solenoid components of the invention which are operators during the latching mode of operation thereof.

Likewise, FIG. 3 depicts a plurality of curves which represent a typical selection of spring and solenoid forces for various rearward mass displacements during the latching mode. Of course, it may readily be appreciated that because the springs are the same ones used in both cases, their respective curves — and, hence, their respective reference numerals — are the same as those illustrated in FIG. 1, in order to be consistent; however, curve 127 represents the suitable selection of cocking solenoid 61 and the forces produced thereby as a result of the timely electrical energization thereof.

In any event, from the disclosures of FIGS. 2 and 3, it may readily be seen that numerous design characteristics are available to the artisan when it becomes necessary to tailor recoil or other motion and/or force type simulations to actual guns, weapons, and other devices. Obviously, it would be well within the purview of one skilled in the art having the benefit of the teachings presented herewith to make whatever design selections as would be necessary with respect to all of the components of the subject invention to optimize it for any given operational circumstances.

MODE OPERATION

Figure 4:
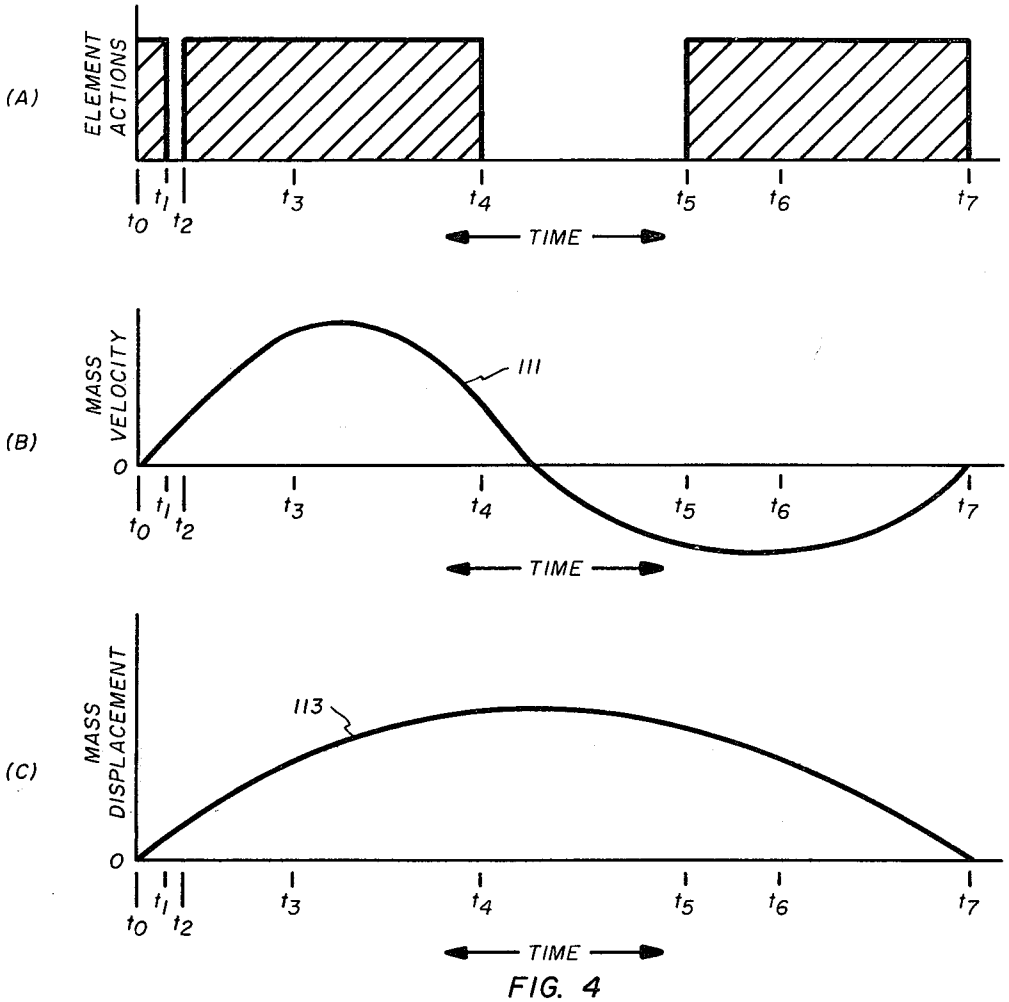
FIG. 4(A), (B), and (C) graphically depict time correlated representations of the sequence of operation of the various parts of the invention and the mass velocities and displacements resulting therefrom, respectively.

The operation of the instant invention will now be discussed briefly in conjunction with FIGS. 1 and 4 of the drawing.

As indicated above, the present invention is intended to provide a simulated but realistic recoil effect to supplement and improve training weapons which do not use live ammunition. Briefly stated, it uses a spring-mass system that is preferably powered by electric solenoids and an electronic timing circuit that is programmed to cause whatever sequence of events as would need to occur for either single or rapid fire modes of operation.

As previously suggested, considerable effort and money has been spent to perfect training weapons which do not use live ammunition but still give the trainee marksman using them the feeling that they are using real ones. A good example is a laser gunnery trainer; but unfortunately, it does not have the feel of a real gun and, thus, it does not supply the trainee with real gun experience. As a result, the trainee's marksmanship training leaves something to be desired. Accordingly, when recoil simulator 11 of FIG. 1 is installed in laser gun 13, the feel thereof more nearly approaches that of the real gun it is intended to simulate than anything that has been used therefor heretofore.

When gun 13 is ready to be fired, certain initial conditions exist in recoil mechanism 55. They are: (1) trigger solenoid 57 is in a deenergized state; (2) latch mechanism 77 is located at its left extremity position (as viewed in FIG. 1,) because it is urged thereto by compression spring 93; latch roller 87 is in contact with and restraining mass 75 and, hence, prevents the leftward movement thereof; springs 71 and 73 resiliently urge mass 75 toward a more leftward position; cocking solenoid 61 is deenergized, after having drawing mass 75 to its "firing" position (as shown); there is considerable play between the right ends of springs 67 and 69 and the left end of mass 75; recoil solenoid 59 is deenergized; and trigger switch 17, which is mechanically connected to gun trigger 15, is open.

When the marksman shooting gun 13 pulls the trigger 15 thereof, it fires a laser light beam in the direction said gun 13 is being aimed. And at the same time trigger 15 is pulled, switch 17 is closed, thereby enabling trigger timer 19. As graphically indicated in FIG. 4(A), such operation occurs at time $t_o$ and continues for the $t_1 - t_o$ time duration because trigger timer 19 is designed to supply an appropriate control signal through resistance 21 to the base of switch transistor 23, thereby causing it to effectively open and conduct and, thus, energize trigger solenoid 57. The energization of trigger solenoid 57, in turn, causes latch mechanism 77 to be pulled to the right against the urging of spring 93, thereby causing cam follower 83 to ride downwardly within cam slot 85 and pull latch roller 87 out of engagement with mass 75, so as to release it. Trigger solenoid 57 is, of course, deenergized at time $t_1$.

The output pulse of trigger timer 19 is also coupled through capacitance 29 to recoil timer 31, and after a predetermined short delay ($t_2 - t_1$) caused thereby, recoil timer 31 produces an output signal at time $t_2$ which passes through resistance 33 to the base of switching transistor 35, causing it to conduct and, thus, to energize recoil solenoid 59. Because mass 75 was previously released, springs 71 and 73 urged it toward the left (as seen in FIG. 1), and when recoil solenoid 59 was energized at time $t_2$, the movement of mass 75 became further boosted because shaft 63 connected thereto was electromagnetically drawn into recoil solenoid 59. Since some play has been designed into the recoil mechanism between the right ends of springs 67 and 69 and the left end of mass 75, said mass 75 initially moves without impediment for a short distance; however, after moving a short distance, mass 75 is being drawn toward recoil solenoid 59 against the urging of said spring 67 and 69, with the time of impact thereof therewith being time $t_3$.

From the above and curve 111 of FIG. 4(B), it may readily be seen that the velocity of mass 75 is controlled as it travels toward the left, with the displacement from its latched position being in the order of that represented by curve 113 of FIG. 4(C). Moreover, it should be obvious to the artisan that the leftward velocity of mass 75 may be varied by properly designing the mass of mass 75, the spring rate of springs 67, 69, 71, and 73, the strength of solenoid 59, and the timing of trigger and recoil timers 19 and 31; therefore, the leftward motion portion of the recoil operation may be controlled in accordance with a predetermined program which simulates a similar portion of actual recoil of a gun shooting live ammunition, such as, for example, that graphically represented in FIG. 4(C).

At time $t_4$, recoil timer 31 ceases producing an output signal and, thus, recoil solenoid 59 is deenergized. Also, as a result thereof, delay timer 41 begins a programmed delay time ($t_5 - t_4$) in accordance with the time delay designed therein. Consequently, during time $t_5 - t_4$, mass 75 is traveling toward the right (as shown in FIG. 1), since it is urged in such direction by the decompression of compressed springs 67 and 69, the compression of which was previously effected by the energization of recoil solenoid 59. As mass 75 accelerates toward the right, it gains momentum, abuts against the left end of springs 71 and 73 at time $t_6$, compressing them. Furthermore, during its travel, the aforesaid time $t_5$ occurs as a result of the output signal of delay timer 41 being timely supplied to the input of cocking timer 45 through capacitance 43. The enabling of cocking timer 45 causes it to produce an output signal at time $t_5$ which is supplied through resistance 47 to the base of switching transistor 49, thereby causing it to effectively conduct and, thus, energize cocking solenoid 61. Of course, the energization of cocking solenoid 61 draws mass 75 to the right, causing it to impact against the urging of springs 71 and 73 at time $t_6$ and then continue its movement until it travels to the place where latch roller 87 rolls off the underside thereof and into the latched position at time $t_7$. Actually, cocking solenoid 61 continues to be energized for just a very, very brief instant after time $t_7$, in order to insure that the positive latching of mass 75 has taken place, after which it is deenergized as a result of the termination of the output signal from cocking timer 45. Once mass 75 is securely latched in place again, the subject recoil simulator is ready for the next firing of the gun.

The movement of mass 75, as previously indicated, is best represented by the curve in FIG. 4(C). Velocity thereof in the forward direction (leftward, as shown in FIG. 1 and to the right graphically as shown in FIG. 4(B)) increases to a maximum at about midway between time $t_2$ and $t_4$ and then decreases until stopped shortly before midway between $t_4$ and $t_5$, at which point it reverses direction and travels rearwardly. Maximum rearward velocity then occurs at about the midpoint between $t_5$ and $t_7$. After which it decreases to a stopped and latched position at approximately $t_7$.

From the above, it may be seen that as mass 75 is moved forward by the combined actions of springs 71 and 73 and recoil solenoid 59, the reaction thereto is in the rearward direction. Hence, the forward movement of mass 75 causes springs 71 and 73 and recoil solenoid 59 to impart a recoil force to the gun, inasmuch as they are fixed thereto. Thus, in this particular case, laser gun 13 "kicks" backward on the shoulder of the marksman for a short period of time resembling the recoil of a real gun.

As mass 75 moves rearwardly during the second half of its cycle, forward forces are imparted to laser gun 13 as a result of reaction thereto. Again, such forward forces resemble those which occur during the firing of a real gun firing live ammunition.

If so desired, trigger timer 19 may be designed to operate in both single fire action each time trigger 15 is pulled and rapid fire action when trigger 15 is held pulled for a period of time, or in the alternative, it may be designed to do one or the other as required by training circumstances. Obviously, it would be well within the purview of one skilled in the art having the benefit of the teachings presented herewith to make such design choices (between, say suitable monostable multivibrators or appropriate oscillators) as would be necessary to effect either type of firing arrangement or both.

Also, if so desired, the same basic spring-mass system could be used in conjunction with miniature air actuators in lieu of solenoids. In such case, an air supply line would be connected to the recoil mechanism to supply the power thereto.

From the foregoing, it may be seen that the subject recoil simulator provides recoil simulations which give a real firing feeling to a non-real but otherwise highly effective laser training gun or other weapon.

Obviously, other modifications and variations of the present invention are possible in the light of the above teachings. It is, therefore, to be understood that within the scope of the appended claims the invention may be practiced otherwise than as specifically described.

What is claimed is:

1. A recoil simulator, comprising in combination:

a movable mass having a predetermined axis along which movement thereof may occur;

first resilient means effectively connected to said movable mass for timely effecting the urging thereof in a certain first manner in one direction along the aforesaid predetermined axis in effective response to a first signal;

first actuator means effectively connected to said movable mass for timely effecting the movement thereof in a certain second manner in timely conjunction with the urging thereof by said first resilient means in said one direction along the aforesaid predetermined axis in response to a second signal;

second resilient means playably spatially disposed from said movable mass for timely inhibiting and subsequently stopping the movement thereof in a certain third manner in said one direction along the aforesaid predetermined axis and for timely effecting the urging thereof in a certain fourth manner in the other direction along the aforesaid predetermined axis;

second actuator means effectively connected to said movable mass for timely effecting the movement thereof in a certain fifth manner in timely conjunction with the urging thereof by said second resilient means and in timely conjunction with the opposition to the urging thereof by said first resilient means in the other direction along the aforesaid predetermined axis in response to a third signal;

means releasably contacting said movable mass for timely effecting the holding thereof in a predetermined cocked position when said mass has been moved a predetermined distance in the aforesaid other direction along said predetermined axis by said second resilient and actuator means; and third actuator means connected to said mass cocked position holding means for timely effecting the release of the aforesaid movable mass.

2. The device of claim 1, wherein said first resilient means effectively connected to said movable mass for timely effecting the urging thereof in a certain first manner in one direction along the aforesaid predetermined axis in effective response to a first signal comprises at least one spring.

3. The device of claim 1, wherein said first resilient means effectively connected to said movable mass for timely effecting the urging thereof in a certain first manner in one direction along the aforesaid predetermined axis in effective response to a first signal comprises:

a first spring having a first spring rate; and a second spring having a second spring rate that is different from said first spring rate.

4. The device of claim 1, wherein said first actuator means effectively connected to said movable mass for timely effecting the movement thereof in a certain second manner in timely conjunction with the urging thereof by said first resilient means in said one direction along the aforesaid predetermined axis in response to a second signal comprises an electric solenoid having a movable armature shaft that is electromagnetically drawn therein in response to the electrical energization thereof by said second signal.

5. The device of claim 1, wherein said second resilient means playably spatially disposed from said movable mass for timely inhibiting and subsequently stopping the movement thereof in a certain third manner in said one direction along the aforesaid predetermined axis and for timely effecting the urging thereof in a certain fourth manner in the other direction along the aforesaid predetermined axis comprises at least one spring.

6. The device of claim 1, wherein said second resilient means playably spatially disposed from said movable mass for timely inhibiting and subsequently stopping the movement thereof in a certain third manner in said one direction along the aforesaid predetermined axis and for timely effecting the urging thereof in a certain fourth manner in the other direction along the aforesaid predetermined axis comprises:

a first spring having a first spring rate; and a second spring having a second spring rate that is different from said first spring rate.

7. The device of claim 1, wherein said second actuator means effectively connected to said movable mass for timely effecting the movement thereof in a certain fifth manner in timely conjunction with the urging thereof by said second resilient means and in timely conjunction with the opposition to the urging thereof by said first resilient means in the other direction along the aforesaid predetermined axis in response to a third signal comprises an electric solenoid having a movable armature shaft that is electromagnetically drawn therein in response to the electrical energization thereof by said third signal.

8. The device of claim 1, wherein said means releasably contacting said movable mass for timely effecting the holding thereof in a predetermined cocked position when said mass has been moved a predetermined distance in the aforesaid other direction along said predetermined axis by said second resilient and actuator means comprises a latch mechanism.

9. The device of claim 1, wherein said means releasably contacting said movable mass for timely effective the holding thereof in a predetermined cocked position when said mass has been moved a predetermined distance in the aforesaid other direction along said predetermined axis by said second resilient and actuator means comprises:

a shaft having a roller attached to one end thereof;

means having a bearing for slidably mounting said shaft therein in such manner that said roller attached to the end thereof may be moved into and out of engagement with said mass;

a cam-follower pin attached to the other end of said shaft;

a cam slot disposed in said shaft mounting means and in contact with the aforesaid cam-follower pin for effecting the movement of said shaft in said bearing in response to a predetermined movement of said shaft mounting means.

10. The device of claim 1, wherein said third actuator means connected to said mass cocked position holding means for timely effecting the release of the aforesaid movable mass in effective response to the aforesaid first signal comprises an electric solenoid having a movable armature shaft that is electromagnetically drawn therein in response to the electrical energization thereof.

11. The invention of claim 1, further characterized by means effectively connected to said recoil simulator for movement thereof in such manner that predetermined recoil characteristics are imparted thereto by the movement of the aforesaid movable mass.

12. The invention of claim 1 further characterized by a weapon effectively connected to said recoil simulator for movement of said weapon in such manner that predetermined recoil characteristics are imparted thereto by said recoil simulator.

13. The invention of claim 1, further characterized by a laser gun effectively connected to said recoil simulator for movement of said laser gun in such manner that predetermined recoil characteristics are imparted thereto by said recoil simulator.

14. The invention of claim 1, further characterized by means connected to the aforesaid first, second, and third actuator means for supplying said first, second, and third signals thereto, respectively, in accordance with a predetermined program.

15. The device of claim 14, wherein said means connected to the aforesaid first, second, and third actuator means for supplying said first, second, and third signals thereto, respectively, in accordance with a predetermined program comprises:

a trigger switch;

an adjustable trigger timer connected to the output of said trigger switch;

a ground;

a first transistor having a base, an emitter, and a collector, with the emitter thereof connected to said ground;

a first resistance connected between the output of said adjustable trigger timer and the base of said first transistor;

an adjustable recoil timer;

a first coupling capacitance connected between the output of said adjustable trigger timer and the input of said adjustable recoil timer;

a second transistor having a base, an emitter, and a collector, with the emitter thereof connected to said ground;

a second resistance connected between the output of said adjustable recoil timer and the base of said second transistor;

an adjustable delay timer;

a second coupling capacitance connected between the output of said adjustable recoil timer and the input of said adjustable delay timer;

an adjustable cocking timer;

a third capacitance connected between the output of said adjustable delay timer and the input of said adjustable cocking timer;

a third transistor having a base, an emitter, and a collector, with the emitter thereof connected to said ground;

a third resistance connected between the output of said adjustable cocking timer and the base of said third transistor; and with the collectors of the aforesaid first, second, and third transistors being the outputs thereof which produce the aforesaid first, second, and third signals, respectively.

16. The invention of claim 15, further characterized by a trigger, adapted to be pulled by a marksman, connected to said trigger switch.

17. The invention of claim 16, further characterized by a laser gun connected to said recoil simulator and said trigger in such manner as to be simultaneously recoiled by said recoil simulator and fired upon the pulling of said trigger.

18. The invention of claim 17, further characterized by a recoilable means connected to said recoil simulator and said trigger in such manner as to be recoiled by said recoil simulator upon the pulling of said trigger.

19. A recoil simulator, comprising in combination:

a movable mass having a predetermined axis along which movement thereof may occur;

first resilient means effectively connected to said movable mass for timely effecting the urging thereof in a certain first manner in one direction along the aforesaid predetermined axis in effective response to a first signal;

first actuator means effectively connected to said movable mass for timely effecting the movement thereof in a certain second manner in timely conjunction with the urging thereof by said first resilient means in said one direction along the aforesaid predetermined axis in response to a second signal;

second resilient means playably spatially disposed from said movable mass for timely inhibiting and subsequently stopping the movement thereof in a certain third manner in said one direction along the aforesaid predetermined axis and for timely effecting the urging thereof in a certain fourth manner in the other direction along the aforesaid predetermined axis;

second actuator means effectively connected to said movable mass for timely effecting the movement thereof in a certain fifth manner in timely conjunction with the urging thereof by said second resilient means and in timely conjunction with the opposition to the urging thereof by said first resilient means in the other direction along the aforesaid predetermined axis in response to a third signal;

means releasably contacting said movable mass for timely effecting the holding thereof in a predetermined cocked position when said mass has been moved a predetermined distance in the aforesaid other direction along said predetermined axis by said second resilient and actuator means;

third actuator means connected to said mass cocked position holding means for timely effecting the release of the aforesaid movable mass;

means connected to the aforesaid first, second, and third actuator means for timely supplying said first, second, and third signals thereto; and means connected to said first, second, and third signal supplying means for triggering the timely generation of said first, second, and third signals thereby.

* * * * *